US006157146A

United States Patent [19]

Dämmig

[11] Patent Number: 6,157,146

[45] Date of Patent: Dec. 5, 2000

[54] PROCEDURE AND APPARATUS FOR SPEED RELATED ERROR CORRECTION OF MEASUREMENT SIGNALS FROM FIBER BAND SPEED IN A TEXTILE MACHINE

[75] Inventor: Joachim Dämmig, Ingolstadt, Germany

[73] Assignee: Rieter Ingolstadt Spinnereimaschinenbau AG, Ingolstadt, Germany

[21] Appl. No.: 09/338,690

[22] Filed: Jun. 23, 1999

[30] Foreign Application Priority Data

Jun. 29, 1998 [DE] Germany ..... 198 28 990

[51] Int. Cl.[7] ..... B65H 59/38

[52] U.S. Cl. ..... 318/6; 19/0.23; 19/240; 73/160

[58] Field of Search ..... 318/4, 6, 11, 563, 318/565; 19/0.23, 239, 240, 260; 57/206; 73/160

[56] References Cited

U.S. PATENT DOCUMENTS

| | | | |
|---|---|---|---|
| 4,199,843 | 4/1980 | Leifeld et al. | 19/240 |
| 4,742,675 | 5/1988 | Leifeld | 57/412 |
| 5,237,754 | 8/1993 | Oexler | 33/501.02 |
| 5,452,626 | 9/1995 | Denz | 74/665 L |
| 5,544,390 | 8/1996 | Hartung et al. . | |
| 5,796,635 | 8/1998 | Damming | 364/563 |

*Primary Examiner*—Paul Ip
*Assistant Examiner*—Rina I. Duda
*Attorney, Agent, or Firm*—Dority & Manning

[57] ABSTRACT

The invention concerns a procedure for correction of error of speed and mechanical related error, particularly in the thickness of a fiber band in a textile machine, especially stretch machines. The purpose of the invention lies in the correction of the speed related errors in measurement signals from an instrument of the textile machine. This purpose is achieved by each measurement value generating a respective corresponding inverse and speed related correction value. By means of this correction value, each measurement value can be correspondingly and individually corrected.

9 Claims, 3 Drawing Sheets

PROCEDURE AND APPARATUS FOR SPEED RELATED ERROR CORRECTION OF MEASUREMENT SIGNALS FROM FIBER BAND SPEED IN A TEXTILE MACHINE

BACKGROUND OF THE INTENTION

The invention is concerned with a procedure for the correction of error in regard to speed related measurement values, in particular, the thickness of a fiber band in a textile machine, more particularly, in a stretch works such as a drawframe.

DE 44 41 067 concerns a controlled stretch works for fiber bands with a feed element for a plurality of incoming fiber bands. In this case, there is available a delay mechanism, a drive system, and a control or regulating means for the drive system. The control, or regulation, reacts to a measurement signal that is sent by the feed element to change the delay of the fiber band by the drive system, so that weight variances in the feed fiber band can be corrected. The regulated stretch works should make possible an improved tendency toward uniformity of the fiber bands, especially by a change in the speed of the feed delivery system by use of braking and acceleration.

The measurement signal of the feed element should be made to conform to and depend on the operating conditions to compensate for changes to the measurements caused by the operating conditions. The state of the technology proceeds from the standpoint of correcting the measurement signal from the feed element on the basis of the output speed (see in said Patent Column 2, lines 52 to 54). This output speed is, however, determined at the exit rolls at the end of the stretchworks arrangement (relative to the calender rolls behind the band receiving hopper.) This approach to speed measurement arises from the conventional concept of the present practice. On the feeler rolls, the speed of the fiber band cannot be determined, because first, delay adjustments are made as part of the control, and second, the feeler roll pair are mechanically interlocked with the delay roll pair. This left only the conclusion to be made that the speed of the fiber band had to be measured at the exit end of the stretch works.

So, from the values of the output speed and the values of the delay, the intake feed speed of the fiber band was then determined by calculation.

This former method of thinking was based on the idea that at the feed entry, speed changes caused by regulation were not available for a measuring instrument. That is, the entry speed as well as the exit speed were assumed to remain equal.

This assumption did not consider the actual available speed changes and the errors which arose therefrom. The use of the delivery speed in the correction which is proposed by the previous state of the technology cannot find support in the actual factual situation. Doing so, leads to the point that an error in the incoming band can be as much as ±25% of the thickness. For instance, at an error of 25%, a rotational speed change of 33% relative to the nominal delay can occur. The use of the exit speed according to the state of the technology again is not supported by the actual body of facts. That described correction process is thus not adaptable to a modern stretch works.

The measurement element is a measuring instrument which actually touches the fiber material. In the spinning world, such measurement elements are known as "feeler rolls", or a feeler probe. A characteristic of the measuring instrument is that a means of sensing, for instance a pivotable roll in a touch roll pair, or a movable probe of a conical sensing probe, touches the moving fiber material. The sensing means is pressed with a specified pressure against the fiber material. The back-thrust from the material is transduced into an electrical measurement signal, the measurement value of which corresponds to the measured thickness of the fiber material.

This kind of measuring element is installed on spinning machines to determine the thickness of the fiber material. Such an element is, for instance, customary for the regulation of the draw works for carding, drawing, or ring spinning machines as well as in the regulation of the entry of fiber material into the spinning box of a rotor spinning machine. The measurement value output by said element is sent to a regulating means which controls the operation center of a spinning machine. The development of a spinning machine with higher productivity is accompanied by an increase in the speed of the fiber material. In place of spinning machines, this advance in regard to a stretch machine will serve to explain the development.

From an original delivery speed of 850 m/min, a speed of 1000 m/min has been achieved, in the case of delivery from modern stretch works. Accordingly, the speed at the feed end is substantially increased. Since regulated stretchworks have a measuring instrument for the control of the delay, in every case, an increasing speed of the fiber material at the measuring instrument is relevant.

It is generally recognized that a disturbing error in the measurement signal is produced when the speed of fiber material is in a startup phase, or the fiber material finds itself at a standstill. This is also true in regard to speed changes at the measuring instrument as a result of the regulation of the delay. It becomes evident, that upon acceleration or braking of the movement of the fiber material, the error of the measured signal will be just that much greater, in direct proportion to the speed difference of the fiber material to be measured.

The disadvantage of this is, that in the presence of speed differences with the moving fiber material, a misleading measurement signal is produced. Upon further conditioning in the control apparatus of a spinning machine, this signal is noticeably disturbing, lending to faulty regulation.

In the case of regulated drawframe, this situation brings about faultily tensioned fiber material during startup, as well as at standstill or during speed changes at the time of can exchange. This yields clear deviations in the band number as opposed to the band number derived from the operational speed.

This quantitative embracing of the speed related error in the measurement signal first became clear upon the installation of digital technology. As a result of a more exact computational ability for the evaluated measurement values, the quantitative effect of the error became noticeable. Previously, the error was always estimated as negligible. From this background, questions arose in regard to the reason for the error.

The fiber material, as occurs with natural fibers, has a fuzziness, a roughness, or hairiness. On this account, there are air inclusions between the fibers. Upon increasing speed of the fiber material, the interfering influence of this factor becomes evident at an increasing rate, in spite of uniform pressure of the feeler means on the fiber material.

SUMMARY OF THE PRESENT INVENTION

It is therefore a principal object of the present invention to correct, in a textile machine, the speed related error in signals from a measurement instrument which touches the fiber material, i.e. fiber band, for the determination of the thickness, or the weight of the fiber material or fiber band. Additional objects and advantages of the invention will be set forth in part with the following description or may be obvious from the description, or may be learned through practice of the invention.

In the case of high speeds of the fiber materials in modern industrial spinning machines, the connection has been found, that upon increasing speed of the fiber material, the degree of the compression of the fiber material by the feeler means of the measuring instrument is lessened, although the specified applied pressure through said feeler instrument remains essentially the same. This leads to an error, dependent on the speed of the fiber material, in a signal regarding the thickness of the fiber material. This becomes obvious, when the error-carrying measurement signal is employed for such an important function, such as, for instance, the regulation of the delay of the fiber material. This erroneous reading might further be used for quality control supervision of the fiber material or a quantity based apportionment of the material feed into the spinning machine. In the older machines, this influence was not sufficiently brought into correction curves for the measurement signal. The concept "fiber material" is to be understood particularly as one or more fiber bands in a textile machine, i.e. draw frame or stretch works.

The quantitative development of the error in measurement signals in relationship to the speed of the to-be-measured fiber material up until now has not been exactly understood. It has been discovered, that the error in the measurement signal represents a function with a rising monotonic, particularly logarithmic curve.

Proceeding from that assumption, at a speed of 0 m/min (standstill), the error has a value of zero. Further, the error is observed up to about 25%. This range of error represents the possible operational situations for the fiber material, and therewith, the greatest error to be compensated for in the said measurement value.

The functional curve of the error shows, that the error is dependent on the speed of the fiber material and the kind of fiber material. Upon startup from standstill in a spinning machine, the fiber material runs through, for instance at the feed end of a stretch works, at speed values from 0 m/min to 290 m/min.

An exact replica of the functional curve of the error, for instance during startup, is scarcely possible to obtain. On the grounds of the customary switching time of digital measurement technology (represents a digital step), the existing intervening values between a measurement reading and the following measurement reading cannot be captured.

During a very short machine startup (about 100 ms) for the fiber material up to operational speed (approximately 290 m/min), an extremely short gate time must be achieved to obtain a sufficient speed measurement in the short startup time. A high resolution, expensive pulse generator would be required. This possibility acts to the contrary, in that with low rotational counts (the RPMs practically zero) such a small pulse frequency of the pulse generator would evolve. In the case of an extremely short gate time, no pulse could be captured for individual gate times.

These factual conditions show themselves in the startup phase as hindering features for the installation of the digital pulse frequency measurement for the exact reproduction of the course of the fiber intake speed and band thickness error.

It has been found that faulty measurement values from a function can be corrected through corresponding assigned values, which are derived from an inverse function. For each measurement point of the speed of the fiber material, there is produced a corresponding error of a measurement value and a corresponding corrective value from an inverse function.

For this purpose, one requires the exact functional curve of the error in relation to changes in the entry speed to determine the exact curve of the inverse function thereof.

Only with an exact, inverse function curve are exact corrective increments available for each value of the entry speed. If the functional curve of the error is not precisely determined, that is, without omissions, then the inverse function derived from the basic function cannot be exact. Within the framework of the invention, the determination of the functional curve of the error (exact) has been omitted. To a much greater extent, the goals of the invention concentrate on a direct determination of the corrective value.

The fundamental, basic, general principle on which the invention rests, lies in that, for a given value, in particular a measured value, there is a respective inverse and speed-dependent corrective value formed. By means of this corrective value, each value will be correspondingly corrected. Collectively, there arises from the measurement values, in dependency on the speed of the fiber band, an advantageously monotonic rising (or falling) course of the functional curve and from the corrective values, an inverse advantageous monotonic falling (or rising) curve. By an inversion of the measuring value curve, that is to say, the single values, an error corrective of the faulty value is obtained. By means of the direct assignment of a correction value for the faulty value, a speed dependent direct influence of the regulation of a stretch machine is attained. Upon startup in accord with correction of the faulty measuring value, a comparison of the fiber band enters, which during the startup extends through the stretchworks. The value to be corrected can, for instance, also be an average of several measurement values or the like.

Within the framework of the invention, it is foreseen to develop this general principle in an empirical and an automatic way, that is, a self teaching concept. In both cases, it will be achieved that the corrective measure curve, after difference computation from faulty measurement value and the respective corrective value, will result in a straight line, which is, essentially parallel to the abscissa. In this case, the settings curve exhibits an increase from zero upwards. After correction of the speed dependent error (measured value), by means of a corresponding, likewise speed dependent correction value, the error free measured value is essentially not speed dependent. First, the empirical correction procedure and its apparatus will be described.

To have a background for an empirical approach for the motion of the fiber band during a change in speed, signals proportional to that change in speed must be produced by means of a measuring instrument. These signals can include, for example, a pulse train or a pulse train with a predetermined pulse repetition rate. This measuring instrument can advantageously be a pulse generator, which is coupled with a roll pair, in particular a fiber material contacting pair. What is measured then, is the rotational velocity of the contacting roll pair, which is an equivalent for the speed of the fiber material running therethrough.

The proportional speed signals thereby emitted, that is the pulse train of the pulse generator, are sent to an evaluation apparatus. The evaluation apparatus includes apparatuses for determination, transducing, and adaption.

The determination apparatus ascertains the pulse repetition period of virtual segment distances on the circumference of the contact rolls relative to the intake speed of the fiber material, such as at startup, at stand still, or in delay related alteration in speeds. In this way, each value of the intake velocity may be assigned to a specific pulse length. The pulse length, in its relationship to the intake speed of the fiber material reflects a monotonic falling, particularly an exponential curve. This determined, monotonic downward curve of the function corresponds to an inverse function curve. This inverse function curve represents a monotonic but upwardly directed and logarithmic curve of the error. In order to work with values from this inverse curve, each value of the pulse length must be converted in a transducing apparatus into terms of frequency.

In a further step, there is effected through inverse formation a transposing of the pulse length. From this transposition, which expresses a kind of reversal or a negation of the measured value, there is formed a delineated outline around an increment of the monotonic falling inverse function in which the value of the pulse length exists.

Each value of the pulse length is eventually input to an adaption apparatus. In this adaption apparatus, the relationships of the fiber material in use are given consideration or matched. This "matching" can be brought about, for instance, by a reinforcement or a weakening. The resulting value, which is now conditioned, represents a corrected value that is now to be used in a corrective apparatus for the correction of the faulty original measurement value.

In order to ascertain, that the now "valid" correction value has its source in the proper inverse function, a "plausibility-examination is executed. To two given speed values, selected as far from each other as possible, the correction, determined as above, is given consideration. In both cases of the speed value, the amount of difference must lie on a common "median line". The "median line" runs parallel to the abscissa. The said examination will show, only by means of the "median line", that the corresponding inverse function has been found.

The correction procedure has the advantage of being independent of the characteristic line of the fiber material at machine startup. The correction procedure accordingly, also operates independently of the speed. Since the same lengths of fiber material sections are being observed, the procedure in this concept is "length dependent".

Besides the above explained empirical correction procedure, it is possible in an alternative development of the general principle to construct the correction procedure as self-teaching. In this way, the error function, contrary to the empirical way, is determined automatically and self sufficiently, so that each faulty and speed-dependent measurement value is corrected immediately by means of self-optimizing and automatic operations without outside intervention. The compensation of the error of a measurement value is done continuously during the operation of the stretch machine. Besides this, the formation of a dynamic adjustment of the error function is provided. By means of the self-correction procedure, it is not necessary to consider material and machine conditioned characteristics and/or the effect of further possible influences.

In accord with the invention, a correction value is evolved out of the measured values of the measuring instrument and a comparative measure value is made. By means of this so developed correction value in combination with the original measured value of the fiber band, the measured values are corrected. All employed and developed values are, on the input side, directly or indirectly connected with the measuring instrument.

It is particularly of advantageous if the measurement value of the fiber band, and/or the correction value, and/or the comparative value, and/or the corrected value is determined in connection with the speed of the fiber band.

In this way, the dynamic adaption and automatic correction of the procedure is achieved in such a manner that the procedure essentially attains a result, which is independent of, but applicable to, all speeds of the fiber band. By the speed-relationship of the thus determined values, these values are dynamically and continuously adjusted. This automatic adaption leads to an autonomous functional operation, without intervention into the run of the process from outside.

Further, it is of advantageous worth if the measured values of the fiber band are captured in predetermined band sections. The procedure takes cognizance of the fact that the fiber band cannot be continually subjected to measurement technology, but rather it is to be measured in sections of predetermined length. The length of the fiber band under examination is chosen adequately small, for instance 30 mm, so that upon startup of the stretch works, the various speeds of the to-be-stretched fiber band are captured upon entry into the textile machine.

Moreover, the fact that average values can be formed from the measurements of the fiber band is advantageous. This average value is presented, in a further development of the procedure, as an average value of a measurement captured by the measuring instrument from the section of the fiber band. In this way, each fiber band section can be assigned an exact average value.

In particular, the dynamic and self teaching auto-correction is advantageously designed so that if the comparative measurement value is expressed as a speed-dependent value at high speeds of the fiber band.

In the case of high fiber band speeds, it may be generally assumed, that the measured values differ insignificantly from one another. That is, the relative change of the measured value is very small. The comparative value so determined serves as a reference for the formation of the correction value.

Further, it is to be preferred that the average value of the fiber band also plays a part in the value of the comparative measurement, particularly if the latter is a sliding scale average. The comparative measurement value forms, respectively, a definite speed of the fiber band section. By means of averaging of the respective average values for several startups, then the determined average measured value of a fiber band section at a definite speed is once again established, so that spontaneous swings in value are averaged out. As a result, one obtains a function which is essentially stable, practically free of value swings, and is dependent upon the speed of the fiber band. In addition to this, the comparative measured value that is used as a reference has a base with small or negligent value swings. In order to acquire the most actual data for the automatic correction, the average values are collected together in accord with the FIFO-principle in a sliding scale average value, for instance, over the most recent 16 startups.

In order to have visible evidence in regard to the textile machine and the fiber bands, the sliding scale average value is advantageously converted into a "Correction Graph" or a "Correction Table." By means of the recording of these values, the data can be analyzed during or after the operation period. Quality and excellence of the produced fiber band and of the operation of the textile machine can be monitored. In a favorable manner, the deviation, that is the correction value, of the fiber band is arrived at from the difference of the average value at high speeds of the fiber band and the average value of a fiber section. By the assignment of the fiber band average value to a respective correction value during the same speed, the individual deviation from the reference value is achieved.

Moreover, the correction measured value is advantageously calculated out of the measured value of the fiber band and the correction value.

That means each measurement value of the fiber band, i.e., the fiber band section, is individually corrected by the deviation of the average value over the entire fiber band section by reference values (average value of several startups of the fiber band at a high speed of the fiber band). In this matter, one proceeds from the assumption that the speed of the fiber band within the length of the selected section is small or scarcely changed. On this account, the selected fiber band section must be very short.

In a development of the invention, collected values, which were taken by the measurement instrument or produced by the method of the invention, were assigned memory storage addresses in at least one memory device, i.e., one computer. By means of conversion of the values into digital values and with the memory device or computer, the obtained data can be easily and quickly managed and computed. With the high capacity and favorable computer chips, now devices are available, which can manage large quantities of data. By the installation of multi-processors, the self teaching autocorrection process is easy and economical to realize.

It is advantageous if the storage addresses of the memory device, i.e. computer, are addresses in dependency on the speed of the fiber band. This makes possible a substantially better and more favorable management of the data. Especially advantageous, in accord with the invention, is the obtaining of virtual band segments of constant length. The pulse length of these segments is determined by means of an apparatus for pulse length measurement. In accord with this, the speed of the virtual band segment is determined. At low fiber band speeds, a large period length arises which, with increasing band speed, becomes lessened. Since the changes of the measurement error at startup are very large, more memory storage is required than at higher speeds of the fiber band, because the relative change of the measurement value at higher speeds in comparison to lower speeds is small. By means of converting period lengths into frequencies, large period lengths, i.e., low frequencies, match up with a large memory demand, and conversely, small period lengths, i.e., high frequencies, match up with a small memory demand.

Through this addressability of the storage spaces with dependency on the speed of the period length, the storage needs can be optimally managed, since little redundance in the data record is present. In the case of startup, more memory capacity is required than during high speed operation of the fiber band. The respective storage address is then, in an advantageous way, defined as a function of the period length, i.e., frequency, of a virtual band segment of constant length. Because of the addressability of the storage (RAM) one obtains an exact copy of the graph of the function.

In order to make a long term record of the machine, the correction graph or the correction table can be advantageously generated or executed during a can exchange of a textile machine. With the correction graph as a reference, the determined measurement value, i.e., sliding scale, may be inferred. The usefulness of a correction table serves for the partitioning and equalization of the computer capacity, if a processor is being used, which possesses too small a computer capacity.

Moreover, it is a goal of the invention to propose an apparatus with which the automatic correction procedure can be carried out. The apparatus for error correction exhibits a measurement instrument, which captures the measurement value of a fiber band running therethrough and inputs the measurement to a correction apparatus. The correction apparatus sends the adapted value to a regulation system for an operating control of a textile machine, in particular, a stretch works. In accord with the invention, the apparatus is developed in such a manner that the correction apparatus contains a device for the formation of the corrected measurement value, it also contains a correction value apparatus, wherein the device for the formation of the corrected measurement value is connected on its input side with the measurement instrument. The measurement instrument captures the original measurement and on that same input side with the correction value apparatus. By this means, measurement values of the measurement instrument are sent parallel to one another to both apparati, (first, apparatus for formation of the corrected measurement value, and second, correction value apparatus).

The correction value apparatus is connected on the output side of the apparatus for the formation of the corrected measurement value. In the correction value apparatus, the deviation of a measurement value from a reference value is determined and forwarded to the apparatus for the formation of the corrected measurement value. In this apparatus, each measured value captured by the measurement instrument is given the corresponding corrective value at the same speed of the fiber band. As a result, the corrected measurement value is sent to a further unit, i.e., the regulation system.

In a further development, the correction value apparatus includes an apparatus for the formation of correction values, which is connected on the input side of an apparatus for the averaging of the measurement values and, further, connected to a comparative measurement apparatus. For the simplification of the automatic correction, average values are developed by a predetermined small fiber band section in the apparatus. The comparative value apparatus delivers a reference value.

Moreover, it is advantageous if the comparative value apparatus is connected on the input side of the apparatus for the average value formation. By means of this connection, the execution of the automatic correction of the determined average value of the fiber band is used for the determination of a reference value. The reference value determines itself therein, in that the relative error change of the measured value at high speeds is very small.

Advantageously, the comparative value apparatus includes an apparatus for the formation of sliding scale average values and/or an apparatus for formation of a correction graph or correction table. By this means, the reference value can be very easily determined.

The correction apparatus is designed into an advantageous embodiment of the invention by means of at least one computer unit. By the availability of computer capacities, the large data quantities can be well managed and evaluated. The computer capacities allows the corrected measured values to be forwarded to the regulator unit or another operational element, in order that the measured position of the fiber band can be correspondingly regulated.

Further, it is provided that the correcting apparatus possesses storage means for the data.

Also, in accord with the invention, the correction apparatus is connected with a feeler apparatus (i.e., a feeler roller), for the fiber band, i.e., the fiber band sections, and/or connected with their device for determining their speed. In accord with the invention, virtual band segments with a constant length are measured, whereby the period length of a band segment will be correspondingly determined. By means of the connection of the correction apparatus with the feeler apparatus, the values can be assigned to one another in the respective sections depending on the speed of the respective section.

Moreover, it is advantageous, if the memory storage apparatus is addressable depending on the speed of the fiber band, i.e., the fiber section. Because of this definite relationship between speed and the values stored in the computer equipment, a definite assignment does exist.

BRIEF DESCRIPTION OF THE DRAWINGS

In the following, the invention will be explained in more detail with the embodiments shown in the drawings.

DETAILED DESCRIPTION

Reference will now be made in detail to the presently preferred embodiment of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
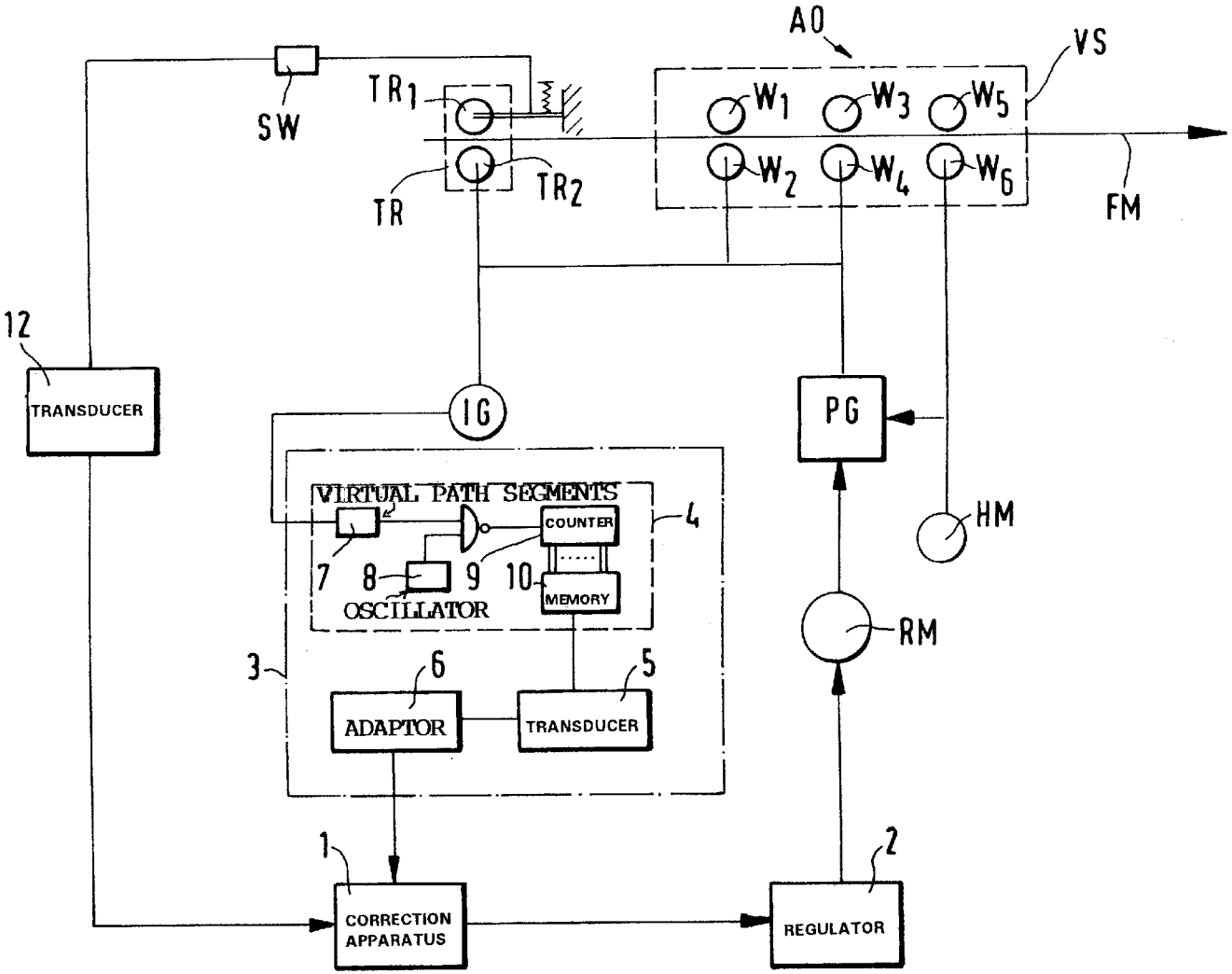
FIG. 1 shows a schematic presentation of the apparatus for the execution of the empirical correction procedure.

FIG. 1 shows fiber material FM in transport in the direction of the arrow. In front of an operational element AO, the fiber material FM is tested for thickness by a feeler or contact roll pair $TR_1$ and $TR_2$. The operational element AO is comprised of stretch works or drawings elements VS. The stretch works VS possess an output delivery roll pair $W_5$, $W_6$, which assures an approximately constant delivery speed for the fiber material FM. The change of the delay is carried out by a regulating motor RM. The regulating motor RM is equipped with a planetary gear drive PG. Through this planetary drive PG, the regulating motor RM imparts to the stretch roll pairs $W_1$, $W_2$ and $W_3$, $W_4$ in case of a change in stretching, i.e., an increase or decrease in speed of rotation. These stretch conditioned rotational speed changes carry over to the contact roll pair $TR_1$ and $TR_2$ because of their mechanical coupling to the stretch roller pairs $W_1$, $W_2$ and $W_3$, $W_4$.

The feeler roll pair $TR_1$, $TR_2$ possesses a stationary, rotating feeler roll $TR_2$ and a pivotably movable feeler roll $TR_1$. The movable feeler roll $TR_1$is pressed against the stationary, rotating feeler roll $TR_2$ with a constant pressure. Upon change in the thickness of the fiber material, the movable feeler roll $TR_1$ changes its thrust. This change in thrust is converted to an electrical signal by a signal transducer SW. This electrical measurement signal represents the thickness of the fiber material. This signal then is sent to an analog/digital transducer 12. The output forms a digital measurement value of the measurement signal. This measurement signal or valve is input into a correction apparatus 1. In correction apparatus 1, a corrective value is produced, which corrects the measured value for the amount of the error. The so corrected measurement is sent to an adjustment regulator 2, which can bring about, based on the correction, a change in the rotational speed of the regulating motor RM. Upon the accomplished rotational speed change of the regulating motor RM, a stretching tension change in the stretch works is effected.

In the following, the explanation will emphasize how the correction value is generated.

A necessary element is a measuring instrument which produces a signal proportional to the speed of the movement of the fiber material. This can be, for instance, an instrument operating on either an analog or digital basis.

In accord with FIG. 1, a digitally operating pulse generator IG is coupled mechanically with the feeler roll $TR_2$. The transport speed of the fiber material FM is proportional in relation to the rotational speed of the feeler rolls $TR_1$, $TR_2$. As a result of the mechanical coupling between the feeler roll $TR_2$ and the pulse generator IG, the latter outputs a pulse repetition frequency proportional to the speed. This speed-proportional pulse repetition rate is input into an apparatus 3 for correction rate generation. The apparatus 3 includes within itself, an apparatus 4 for period length measurement, a transducer 5 and an adaption apparatus 6. The apparatus 4 for period length measurement also contains an apparatus 7 for providing virtual path segments, i.e., the generation of pulse periods. The apparatus 7 for providing virtual path segments, as stated, contains the speed proportional pulse repetition rate. By means of interrupt control, for instance every 20 pulses is periodically marked off, that is, produced. The distance from one up to the 20th pulse corresponds to a period. This period is so chosen, because it reflects a travel section of the fiber material transported between the contact feeler roll pair. In the way of example, the distance between every 20th pulse from the pulse repetition rate represents a length of transport of 30 mm. The circumference of the feeler roll is apportioned into circular segments of known length, for instance 30 mm). Such periods are input to the period length counter 9. An oscillator 8 delivers pulses of a specified frequency. After the running of a period, then the period length counter 9 delivers the result to a period length intermediate memory 10. The period counter 9 is switched to "reset" and operates in renewed condition with the subsequent period.

A compilation of these values or the period length provides a monotonic, decreasing, particularly logarithmic curve to which an inverse function for the error curve may be plotted.

So that this inverse function, because of its endpoint at infinity, can be useable, intermediate steps allow its use for the error curve. For this purpose a conversion computation of the values of the period length T to values of frequency is made, and then a retro-calculation of the values to period length is computed. These calculations are realized by transducer 5.

The value from transducer 5 is input to the adaptor 6. In adapter 6, the value adaption to the fiber material being used occurs. In adapter 6, the characteristics of the fiber material are taken into account, such as fuzziness and compressibility. This is done by means of a multiplication factor, that correspondingly reinforces or weakens the respective value. Thus, the fiber band-dependent influences, i.e. factors, can be determined by an empirical method of operation and input into adapter 6 as pre-specified data. In this way, the inverse function is so brought into a coordinate system, that it lies precisely on the speed dependent error curve. In a further development of the invention, adapter 6 can be manually activated, that is, in accord with the type of the fiber, the adaption can be altered by the operating personnel.

This so adjusted correction value now leaves the adapter 6 and exits apparatus 3, whereupon it is sent into correction apparatus 1. The correction of each original measurement value by this incoming corrected value is accomplished in correction apparatus 1. Thus, regulator control 2 contains the now fully corrected measurement value.

In order to check the correction value produced by the correction procedure, that is, the position of the pertinent inverse function, a settings control is necessary.

Figure 2:
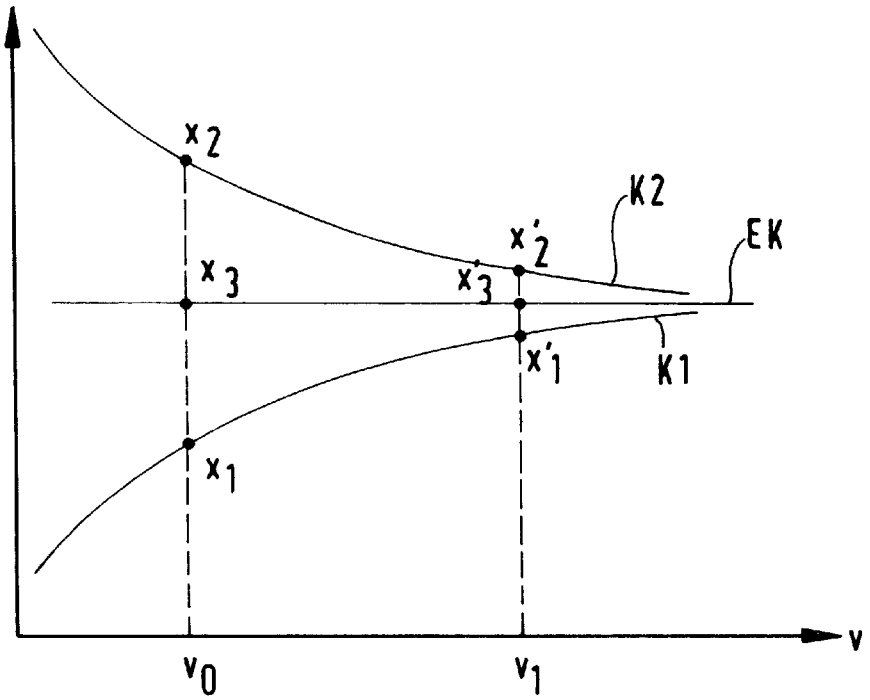
FIG. 2 shows schematically, the adjustment setting curve of the empirical correction procedure.

A possibility for making this check is found in observing the resulting correction of two speed values, which lie as far from one another as possible. For each speed value, the difference between erroneous value and corrected value must lie on a common settings curve. FIG. 2 shows such a settings curve EK. Furthermore, the monotonic, rising, especially logarithmic running curve of Function $K_1$ is shown. For a speed value $v_o$ during the startup, a correction of $x_1$ has been determined.

From this is determined the corresponding erroneous value $x_2$. From the erroneous value $x_2$, the deduction of the corrective value $x_1$ gives a difference value of $x_3$. An analogous procedure method will be made to another speed value $v_1$. The correction value $x'_1$ is determined and the error value $x'_2$ is determined. The two determined difference values $x_3$ and $x'_3$ must lie on a straight line, which runs parallel to the abscissa. If this is the case, then the conditions are fulfilled, in that difference value $x_3$=difference value $x'_3$ and thus to the error curve, a correctly determined inverse curve $K_2$ is established. That is the goal of the settings curve.

In actual practice, it may come about, that the settings control does not immediately show an equivalence of the difference values of $x_3$ and $x'_3$. In such a case, for instance, it is required that through an optimizing procedure (iterative procedure) the equality of the different values $x_3$ and $x'_3$ are fixed. The finding of this optimal value can be done as follows:

The correction procedure is isolated from the stretch operation. Therefore, the machine obtains no correction values, that is, no faulty measuring values would be delivered. The possibility exists of examining the pressure of the contact roller at various values of the speed, including during the startup. The pressure is changed in one direction and again installed with a new value. Then the measurement is taken again at a different speed and the determined increase between the two points is examined in regard to its approach to the real, predetermined error curve.

Figure 3:
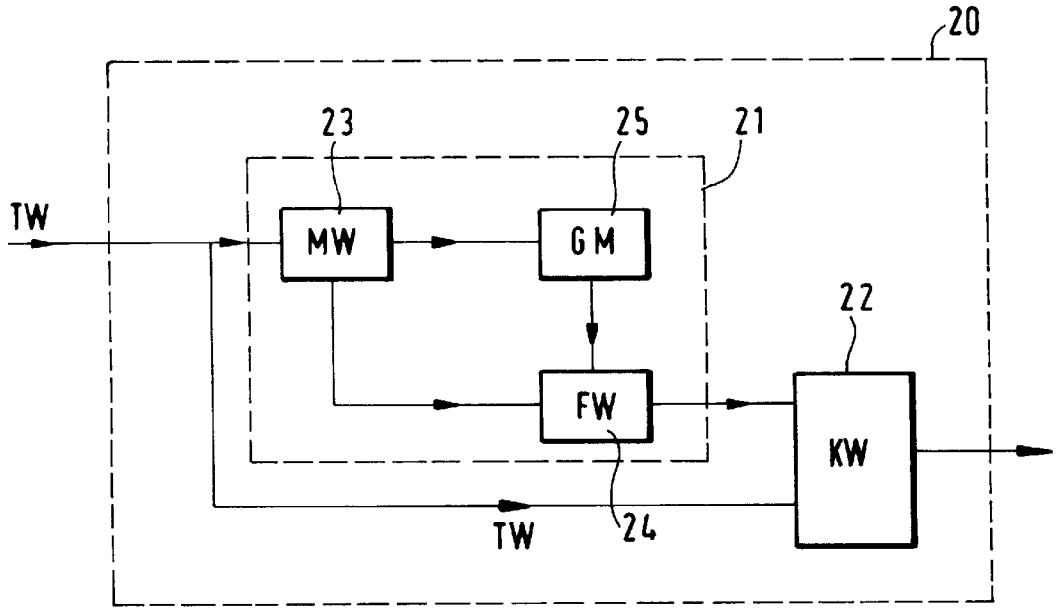
FIG. 3 shows a schematic presentation of an apparatus for a self-optimizing correction procedure.
Figure 4:
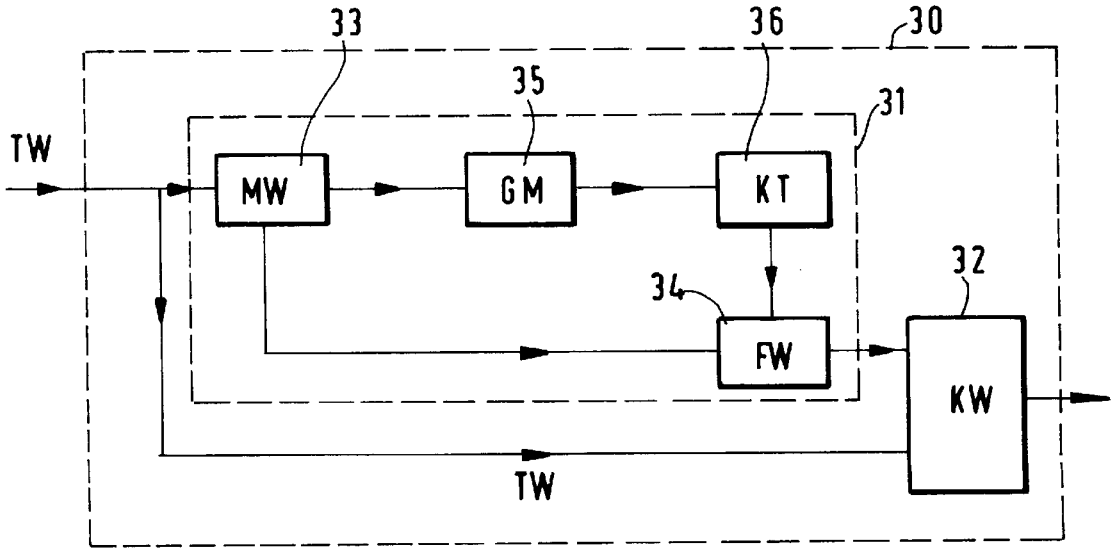
FIG. 4 shows a schematic presentation of an alternative to the self-optimizing correction procedure.

FIGS. 3 and 4 show, respectively, an embodiment of a correction apparatus 20, 30, in accord with the self teaching and self optimizing error correction at band measuring sensors, i.e., on a stretch works or drawing equipment. In both cases, the correction apparatus 20, 30 respectively are loaded on the input side with measuring values TW of a known measuring instrument (see FIG. 1). Each of the correction apparatuses 20, 30 are further comprised of a correction value evaluation apparatus 21, 31 and an apparatus 22, 32 for the formation of the correction measurement value. The two apparatuses 21, 22, 31, 32 are supplied in parallel paths with the measured value TW. From the output side, the corrected value apparatus 24, 34 delivers a corrected value to the apparatus for the formation of a corrected measurement 22, 32.

The correction apparatus 20, 30, on its outlet side, sends the error-free measuring value which is produced for formation of corrected measuring values in the apparatus 22, 32, to a regulator 2 for operational control.

The measuring value TW delivered to the correction value apparatus 21, 31 from the feeler roller, which presents the measurement value of a fiber band segment, were averaged in an apparatus for average formation, 23, 33. From this apparatus for average formation, the averaged mean value MW of a fiber band segment is forwarded to a comparator apparatus 25, 35. In this comparator apparatus 25, 35, the average values, which were made at a particular fiber band speed, were compiled on a sliding average from about 16 starting operations of the machine. This apparatus operates in accord with the FIFO principle, that is, if, over n runs of band, a sliding average is formed and after a further start, the (n+1) average value is obtained at this specific speed, then the first average value is struck out and the new (n+1) comes into consideration for the new sliding average value GM. This process assists in that only actual values for the determination of a comparative value are brought into the computation. The comparative measured value is a value from the obtained function graph which is obtained as an average value determined at high fiber band speeds. At this high speed, the relative change of the measurement is negligibly small, so that a nearly error free measurement value can be assumed. The sliding average GM used as a reference value, found at a high fiber band speed, is sent to an apparatus for the formation of corrective values 24 (FIG. 3).

The average values of a fiber band segment MW will, simultaneously with the above, be sent in parallel directly to the apparatus for the formation of correction values 24, 34. In this apparatus 24, 34, the difference between the reference value and the average value MW of a fiber band segment is formed. As a result, the error deviation is obtained, that is, the error FW. Error FW is forwarded from the correction value apparatus 21, 31 to the apparatus for the formation of the corrected measurement values 22, 32. At this apparatus 22, 32, the measurement data from the feeler roll TW is delivered parallel to the illustrated conditioning path in the correction value apparatus 21, 31.

In the apparatus 22, 32 for the formation of the corrected measuring value, the sum of the measurement data TW and the error values FW is made. As a result, essentially faultless measurements are obtained that, for instance, can be sent further to a regulating unit.

In the development and alternatives of the procedure and the apparatus of FIG. 3, it is possible as in FIG. 4, to forward sliding average value GM which was formed in the comparator apparatus 35, to an apparatus 36 for the formation of a corrective graph or a corrective table. From this correction table, in the above described concept the comparative value will be determined, which is forwarded to the apparatus for the formation of corrective value 34 (FIG. 4). The transfer of the sliding average value GM in a correction table KT is to only be preferred when insufficient computer capacity is available and thus, supplies a compensation for the overdemand on the processor. The transmission of the sliding average value GM into the correction table KT can be done advantageously, when a can exchange is being made on the machine.

By means of the constant updating (above all, the sliding average GM), new data always stand available for the correction of the measured values, which represent the actual characteristics of the fiber band that are at hand in the textile machine. In this way, the procedure is self teaching and self optimizing and takes on the characteristics of the fiber bands currently running in the textile machine. It also takes on the characteristics of the production relevant influences, so that a dynamic adaption of the measured values is updated and carried out continuously.

For an easier management of the data, the presented procedure is designed into a computer apparatus with storage addresses. Since, in accord with the procedure, measurement of virtual fiber band segments with a constant length were taken, the period lengths of which were determined by an apparatus for period length measurement (see FIG. 1), then the measured period length may be used for the purpose of addressing the RAM storage cells of the computer equipment. Since each storage cell is assigned a specified speed of the fiber band, then an exact reproduction of the function graph of the measurement values and the deviation is stored therein.

Contributing to this is the apparatus for the period length determination connected with the correction apparatus 20, 30. In a further alternative, the apparatus for period length measurement is connected with individual apparatuses for the correction apparatus 20, 30.

Figure 5:
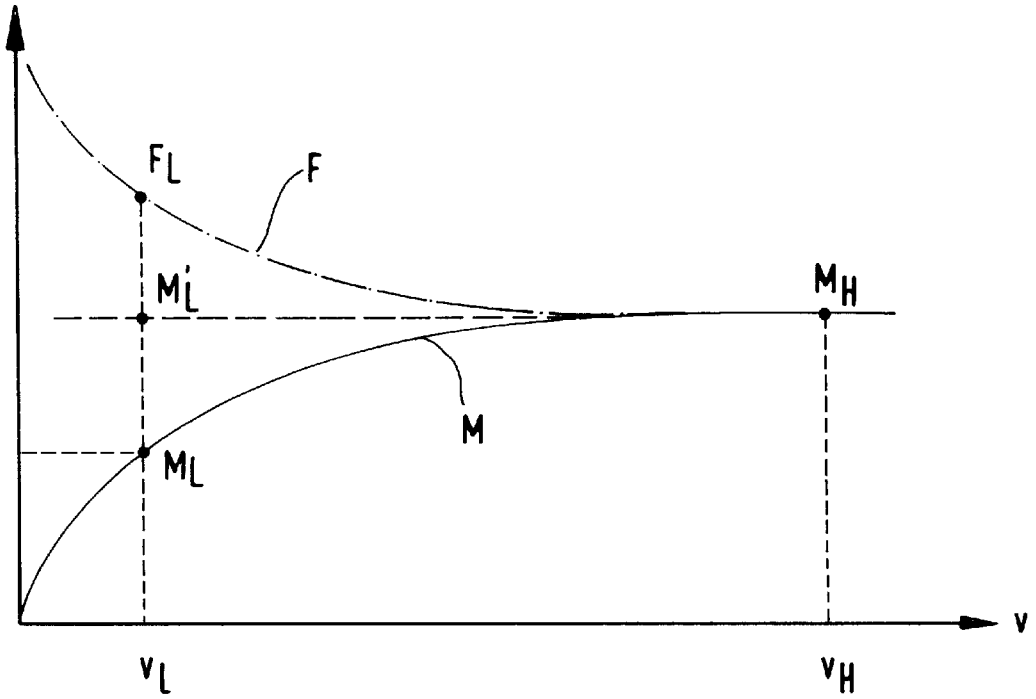
FIG. 5 shows a schematic presentation of the graphs of the function.

In FIG. 5 the function graphs of the average values M is presented, that is, the sliding average and the deviation F in connection with the fiber band speed. The function graph M represents a monotonic, rising function curve which approaches a straight limit line asymptotically. In accord with the procedure, in the case of a high speed of the fiber band $v_H$, a reference value $M_H$ is determined. From this reference value $M_H$, all other values of the function graph M are drawn. On this basis, the deviation of the respective measurement values is formed which provides the deviation curve F. Thus, at every speed to each determined measurement value, a corresponding error value, i.e., deviation value, is uniquely determined. For instance, at a low fiber band speed $v_L$, an average $M_L$ with the deviation value $F_L$ is determined. For the correction of the measurement value $M_L$, the sum is formed out of the two values of $M_L$ and the deviation value $F_L$.

In this way, the error-free measurement value $M'_L$ is obtained which is forwarded to the regulation control unit of a stretch works.

The advantage of the self teaching, self optimizing procedure is, that the error function, that is to say, the deviation of the respective measurement values are found on an individual basis, which adapts itself to a compensation of the measurement error. It is not necessary that any manual corrective operation from the outside must intrude into the operating sequence of the correction procedure.

Altogether, the invention makes possible a better control of the fiber bands, for instance, in a stretch machine and upon startup of a stretch machine. This can be carried out just as well either on an empirical basis or in a self-optimizing manner.

What is claimed is:

1. A method for correcting fiber band thickness measurement values used in a textile machine control or regulating system for speed dependent measurement errors, said method comprising:

measuring fiber band thickness as the fiber band is conveyed through a measuring device at different speeds and generating actual thickness measurement values at the different speeds, the actual measurement values having a rising or falling functional curve as a function of speed;

determining correction values to be applied to the actual thickness measurement values as a function of speed, the correction values having an inverse speed relationship as compared to the actual thickness measurement values;

applying the correction values to the actual thickness measurement values to generate corrected thickness measurement values; and sending the corrected thickness measurement values to the textile machine control or regulating system for subsequent use in operating the textile machine.

2. The method as in claim 1, further comprising determining initial fiber band speed through the measuring device with a pulse train generator, and using a characteristic of speed proportional pulses generated thereby in determining the correction values.

3. The method as in claim 2, wherein the characteristic of the speed proportional pulses is pulse length.

4. The method as in claim 2, wherein said determining the correction value for each actual thickness measurement value comprises generating a comparative measurement value from actual thickness measurement values taken at relatively high fiber band speeds where speed dependent errors are negligible, the comparative measurement value being a reference value forming a basis of the correction value.

5. The method as in claim 4, further comprising computing an average thickness measurement value over a length of the fiber band and subtracting the reference value from this average thickness measurement value to define the correction value; and applying the correction value to the actual thickness measurement value.

6. The method as in claim 5, further comprising re-computing the average thickness measurement value on a sliding scale basis with additional actual thickness measurement value.

7. The method as in claim 6, wherein the average thickness measurement value is based on an initial predetermined number of actual thickness measurement values at relatively high fiber band speeds where speed dependent errors are negligible and additional actual thickness measurement values are computed into the average thickness measurement value on a first in first out basis.

8. The method as in claim 4, wherein said average thickness measurement value is converted to a corrective graph or table, and the comparative measurement value is determined from the graph or table.

9. The method as in claim 5, wherein said method steps are carried out by a computer having a memory device that is stepped in accordance with fiber band speed for computing the average thickness measurement value, the correction value, and the corrected measurement value.

* * * * *